US012502006B2

(12) United States Patent
Yang

(10) Patent No.: US 12,502,006 B2
(45) Date of Patent: Dec. 23, 2025

(54) AIR MATTRESS AND METHOD FOR MANUFACTURING AIR MATTRESS

(71) Applicant: Kwan-Sik Yang, Chungcheongnam-do (KR)

(72) Inventor: Kwan-Sik Yang, Chungcheongnam-do (KR)

( * ) Notice: Subject to any disclaimer, the term of this patent is extended or adjusted under 35 U.S.C. 154(b) by 70 days.

(21) Appl. No.: 18/702,017

(22) PCT Filed: Oct. 13, 2022

(86) PCT No.: PCT/KR2022/015476

§ 371 (c)(1),
(2) Date: Apr. 17, 2024

(87) PCT Pub. No.: WO2023/068649

PCT Pub. Date: Apr. 27, 2023

(65) Prior Publication Data

US 2024/0407565 A1 Dec. 12, 2024

(30) Foreign Application Priority Data

Oct. 22, 2021 (KR) ..... 10-2021-0141876

(51) Int. Cl.
*A47C 27/08* (2006.01)
*A47C 27/10* (2006.01)

(52) U.S. Cl.
CPC ..... *A47C 27/087* (2013.01); *A47C 27/082* (2013.01); *A47C 27/083* (2013.01); *A47C 27/10* (2013.01); *A47C 27/081* (2013.01)

(58) Field of Classification Search
CPC ... A47C 27/087; A47C 27/082; A47C 27/083; A47C 27/081; A47C 27/10; A61G 7/05776; A61G 7/05769
USPC ..... 5/713, 710, 706, 655.3, 654, 644
See application file for complete search history.

(56) References Cited

U.S. PATENT DOCUMENTS 1,673,636 A * 6/1928 Perry ..... A47C 7/021 267/117
3,653,083 A * 4/1972 Lapidus ..... A61G 7/05776 5/709
3,778,851 A * 12/1973 Howorth ..... A61G 7/057 5/709
4,930,174 A * 6/1990 Hunter ..... A47C 27/081 417/479

(Continued)

FOREIGN PATENT DOCUMENTS

CN 118139566 A * 6/2024 ..... A47C 27/10
EP 4403073 A1 * 7/2024 ..... A47C 27/10

(Continued)

*Primary Examiner* — Robert G Santos
(74) *Attorney, Agent, or Firm* — IPLA P.A.

(57) ABSTRACT

An air mattress includes: heat-fused lines formed by pressing and thermally fusing pocket system intake and exhaust ports, tube system intake and exhaust ports, and tube members arranged between a lower sheet and an upper sheet; a pocket system, which includes the pocket system intake and exhaust ports, air pockets, and connection parts between the air pockets bordering the tube members, and serves to support a user's weight; and a tube system, which includes the tube system intake and exhaust ports, the tube members, and communication parts between the tube members, and serves to block the airflow between the air pockets.

6 Claims, 10 Drawing Sheets

(56) References Cited

U.S. PATENT DOCUMENTS

| | | | | | |
|---|---|---|---|---|---|
| 4,942,634 | A * | 7/1990 | Saloff | A47C 27/085 | 5/655.5 |
| 5,022,110 | A * | 6/1991 | Stroh | A61G 7/05769 | 5/691 |
| 5,168,589 | A * | 12/1992 | Stroh | A61G 7/05769 | 5/710 |
| 5,265,293 | A * | 11/1993 | Spahn | A47C 27/081 | 5/724 |
| 5,590,428 | A * | 1/1997 | Roter | A47C 27/081 | 297/180.13 |
| 5,675,855 | A * | 10/1997 | Culp | A47C 27/146 | 5/709 |
| 2024/0407565 | A1 * | 12/2024 | Yang | A47C 27/083 | |

FOREIGN PATENT DOCUMENTS

| | | | | | |
|---|---|---|---|---|---|
| JP | 2024536606 | A * | 10/2024 | A47C 27/10 | |
| KR | 1020190072755 | | 6/2019 | | |
| KR | 1020200042233 | | 4/2020 | | |
| KR | 20230057738 | A * | 5/2023 | A47C 27/10 | |
| KR | 102614883 | B1 * | 12/2023 | A47C 27/10 | |
| WO | WO-2023068649 | A1 * | 4/2023 | A47C 27/10 | |

* cited by examiner

AIR MATTRESS AND METHOD FOR MANUFACTURING AIR MATTRESS

BACKGROUND

The present invention relates to an air mattress, in which, when used as a mat, an air layer inflated into a sealed space formed by a bilaminar airtight fabrics and a bonding line between the bilaminar airtight fabrics supports a user's weight to provide insulation and cushioning between the user and the floor, and which when not used, is deflated to reduce the volume and is folded for easy handling, and a method of manufacturing an air mattress.

In general, an air mattress is formed with airtight fabric in a rectangular shape with a predetermined height to be sealed, and has one or more valves to inject air. By inflating and deflating air through the valves, it is convenient for transportation and movement, and the air mattress can be used not only for leisure activities such as hiking and traveling but also as a medical device for preventing bedsores. The air mattress includes not only an air layer inside but also reinforcing bars erecting inside to connect the top and bottom, or fiber yarns penetrating from top to bottom and formed continuously and densely, thereby preventing twisting and slipping during use and facilitating contact with the curved human body.

However, such a conventional air mattress as described above has a disadvantage in that in the case in which the reinforcing bars are formed inside, the reinforcing bars may be detached and the detached reinforcing bars are neglected inside due to difficult repairing, causing deterioration in cushioning. Moreover, in the case in which the air mattress is formed with a plurality of fiber yarns, the flatness of the air mattress decreases due to entangled fibers, and if some fiber yarns are broken and continuously loosened, airtightness and sealability are deteriorated.

The background technology of the present invention is disclosed in Korean Utility Model Registration No. 20-0388951, published on Jun. 28, 2005.

SUMMARY OF THE INVENTION

Accordingly, the present invention has been made to solve the above-mentioned problems occurring in the prior arts, and it is an objective of the present invention to provide an air mattress, which overcomes the problems of the conventional air mattresses: insufficient insulation and cushioning between a user and the floor due to excessive sagging of the part where the user's weight is applied; difficulty in the user's moving or turning over on the air mattress due to the large height difference between the part sagged by the user's weight and the part to which the user's weight is not applied and which swells due to the ballooning effect and a wide contact (friction) area between the user and the air mattress; the need to inflate air orally or the need to prepare an air pump; the discontinuity when inflating or deflating air with an air pump; the risk that a person who steps the air mattress may lose balance and fall over due to the height of the air-filled mattress; and the difficulty in dehydration when washing as the air mattress is made of airtight fabric, and a method of manufacturing an air mattress.

To accomplish the above object, according to the present invention, there is provided an air mattress, which includes a plurality of air pockets that can allow or block the flow of air filled in the air mattress, such that the air pockets support a user's weight in a state in which the flow of air blocked between the air pockets, to alleviate excessive sagging of the part where the user's weight is applied, which was shown in the conventional air mattress, thereby providing insulation and cushioning between the user and the floor, and allowing the user to more easily move or turn over on the air mattress by reducing the height difference between the part sagged by the user's weight and the part to which the user's weight is not applied and the contact (friction) area between the user and the air mattress. Moreover, some portions of the air mattress serve as air pumps, so there is no need to blow air into the air mattress orally or prepare an air pump. Furthermore, two pocket system air intake pumps, two tube system air intake pumps, one pocket system air discharge pump, and one tube system air discharge pump are provided in pair, such that pressure is applied to the paired pumps, thereby continuously injecting and discharging air. Additionally, heat-fused points are formed by pressing and thermally fusing a central position or some portions of the mattress member on the plane of the air pockets at regular intervals to allow an appropriate adjustment of the height of the air mattress filled with air, thereby reducing the risk that a person who steps the air mattress filled with air loses balance and falls over. In addition, holes or gaps assisting drainage are located in the heat-fused points, thereby making dehydration easy when the air mattress made of airtight synthetic resin fabric is washed.

According to the present invention, the air mattress and the method of manufacturing the air mattress can provide insulation and cushioning between the user and the floor by alleviating excessive sagging of the part where the user's weight is applied, can allow the user to more easily move or turn over on the air mattress by reducing the height difference between the part sagged by the user's weight and the part to which the user's weight is not applied and the contact (friction) area between the user and the air mattress, do not need to inflate air orally or to prepare an air pump, can continuously inflate or deflate air, and can reduce the risk that a person who steps the air mattress filled with air may lose balance and fall over, and can make dehydration easy when washing.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, the present invention will be described in detail with reference to the attached drawings.

Figure 1:
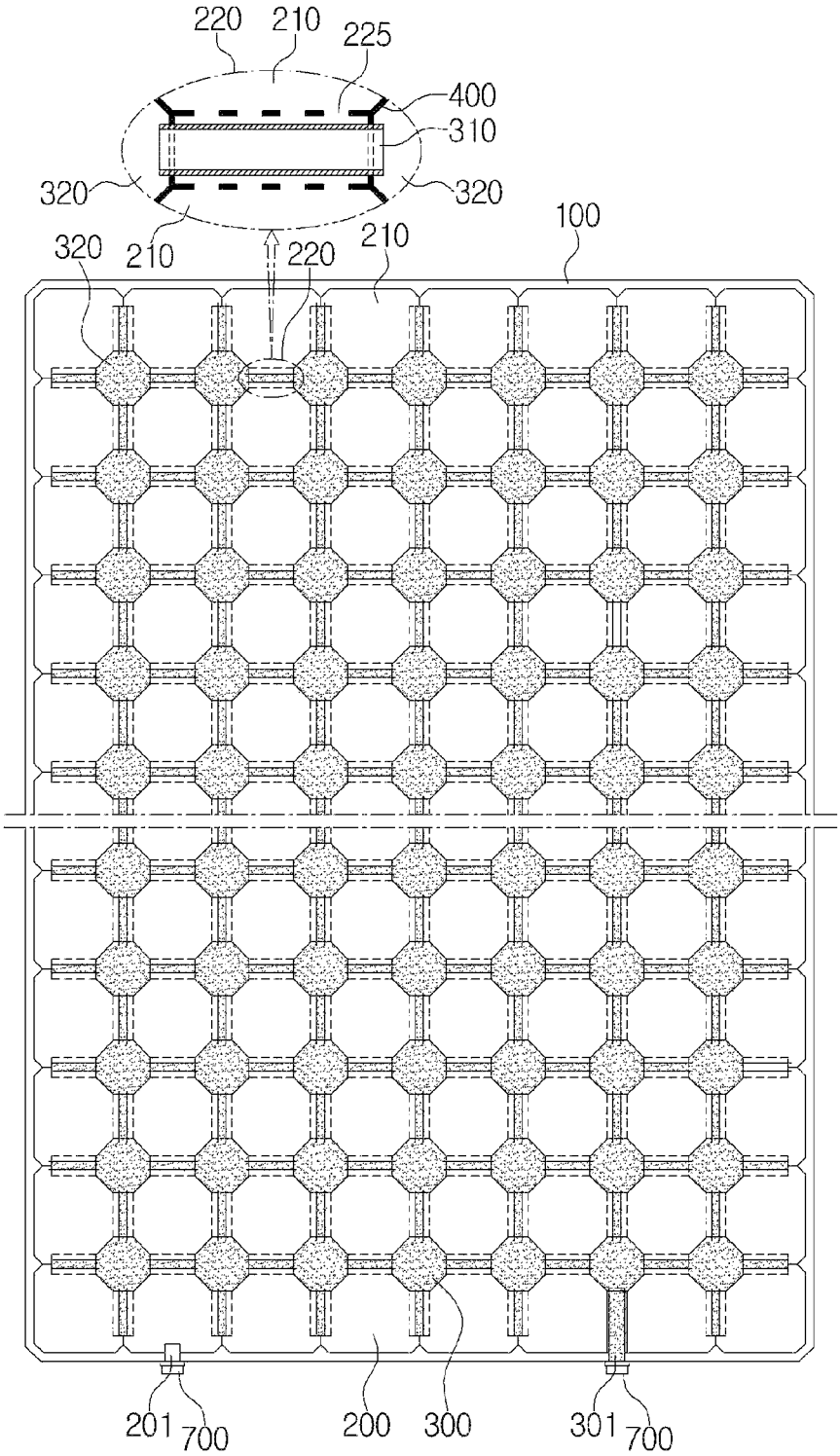
FIG. 1 is a plan view illustrating an air mattress according to an embodiment of the present invention.
Figure 2:
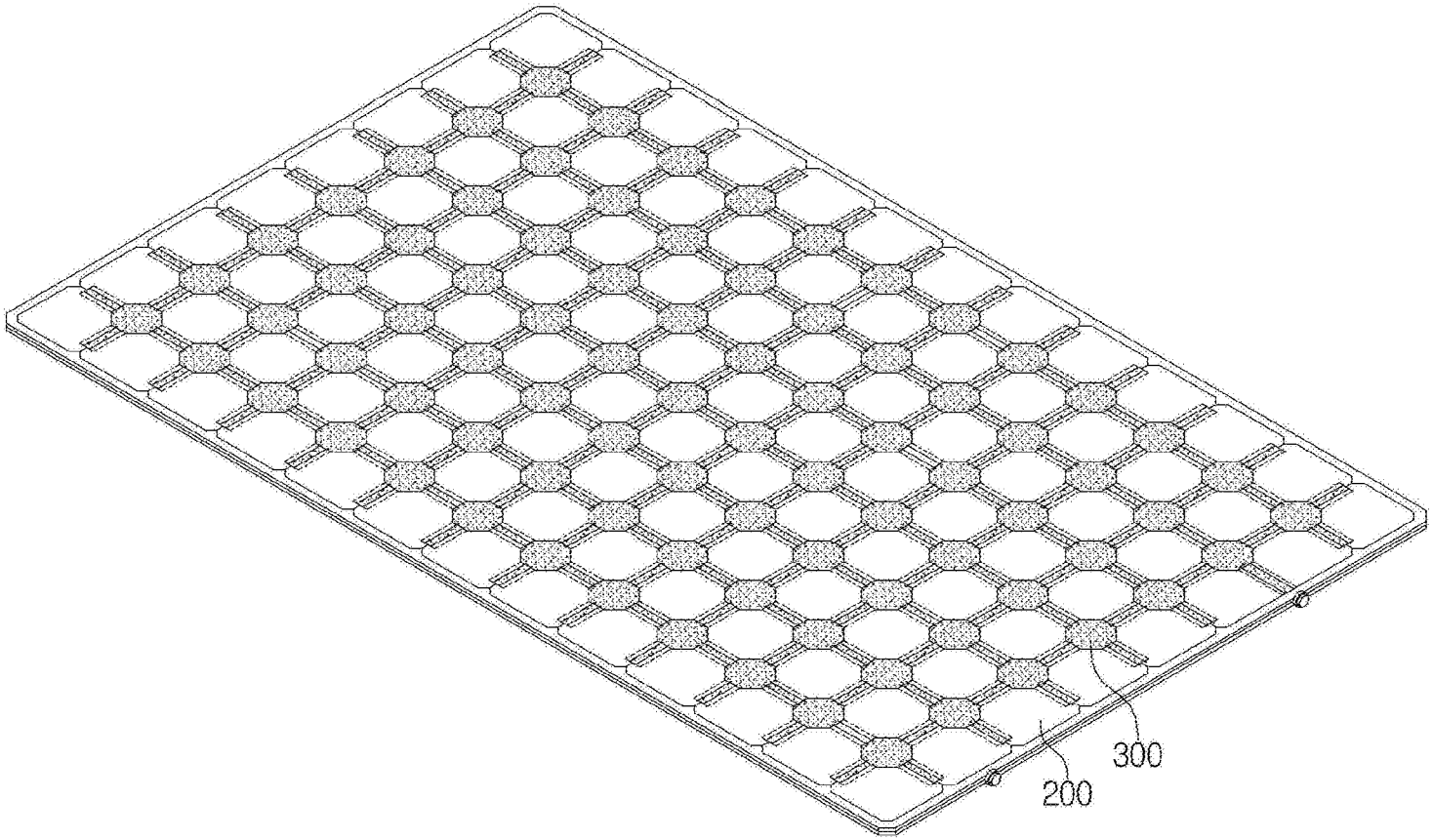
FIG. 2 is a perspective view illustrating an air mattress according to an embodiment of the present invention.
Figure 3:
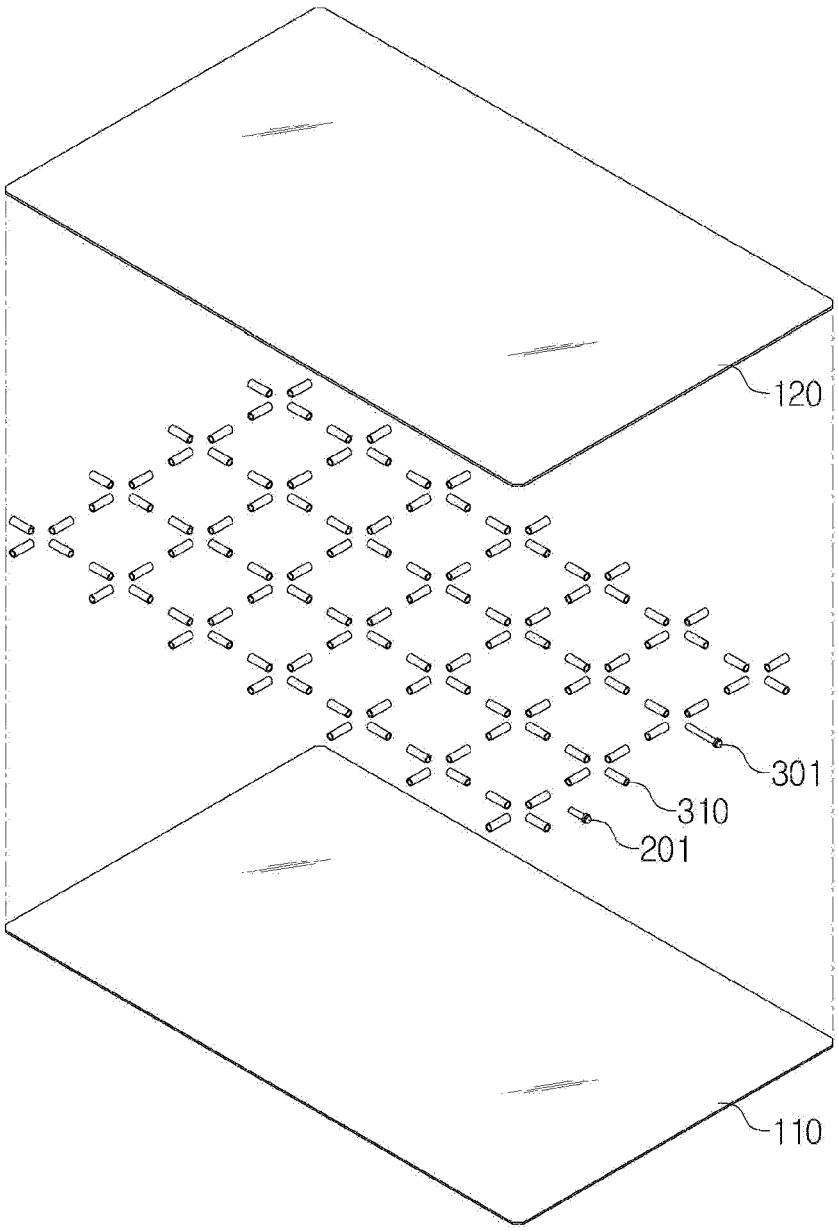
FIG. 3 is an exploded perspective view illustrating an air mattress according to an embodiment of the present invention.
Figure 4:
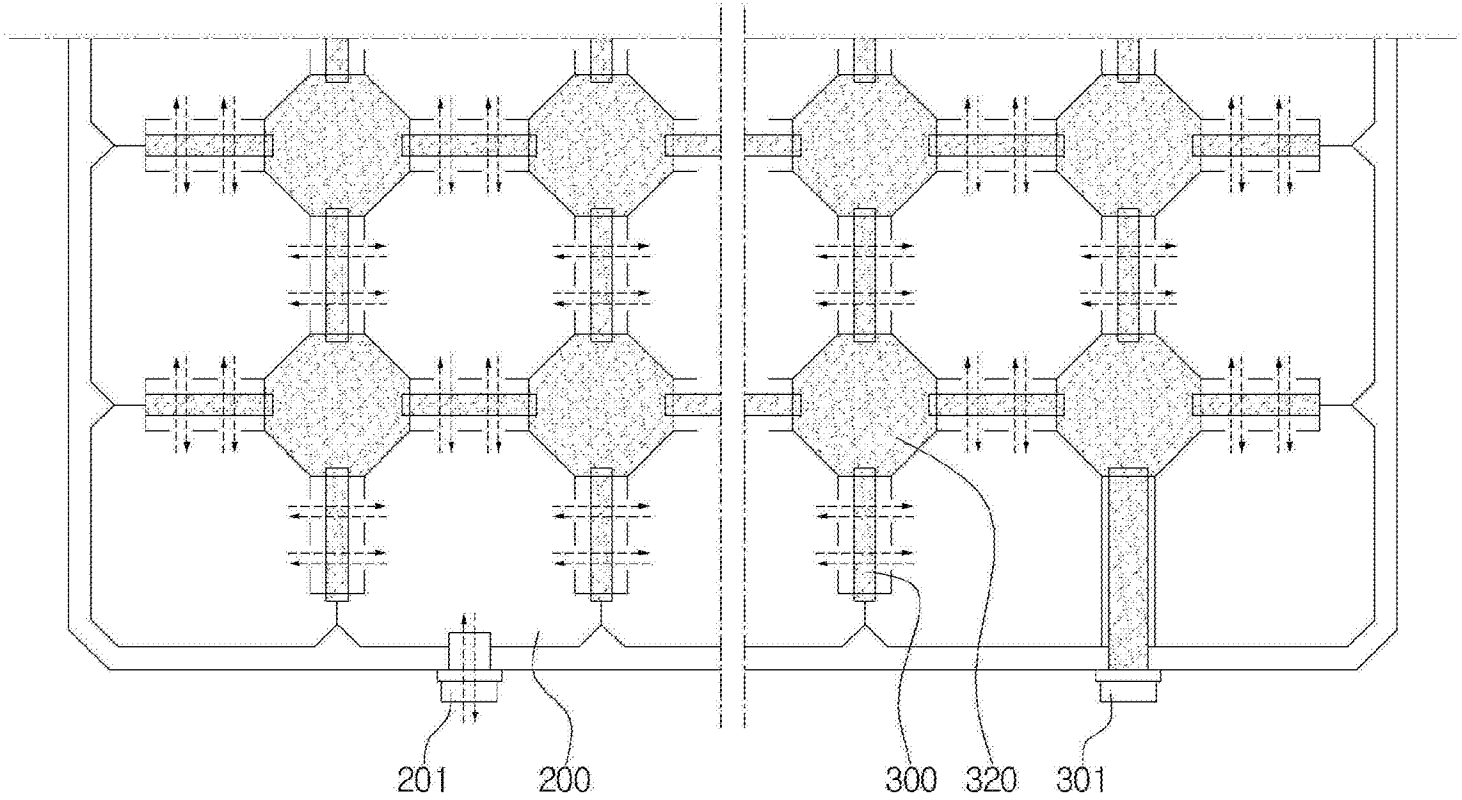
FIG. 4 is a plan view illustrating the airflow of a pocket system 200 according to the present invention.
Figure 5:
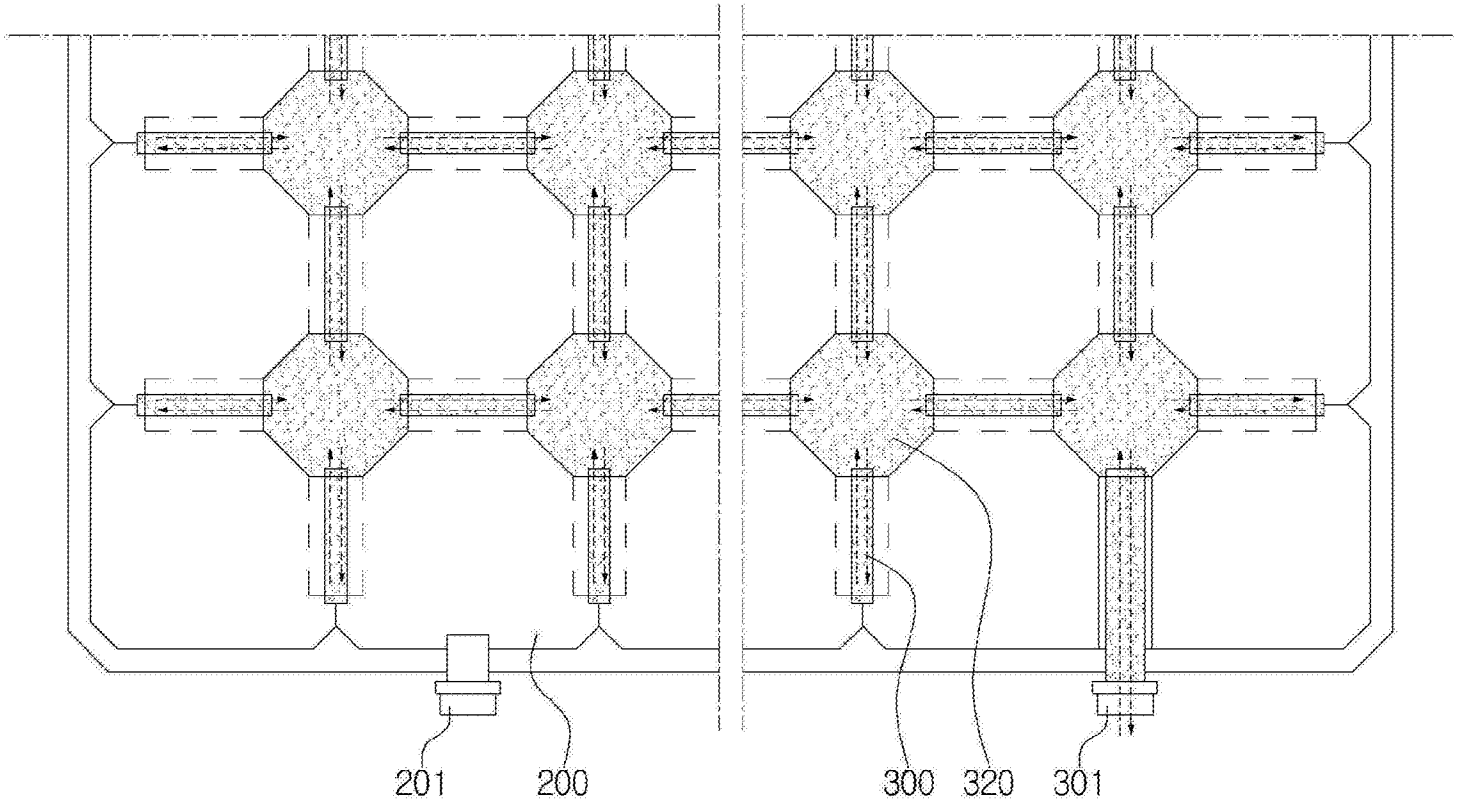
FIG. 5 is a plan view illustrating the airflow of a tube system 300 according to the present invention.

As illustrated in FIGS. 1 to 3, an air mattress according to an embodiment of the present invention includes: heat-fused lines 400 formed by pressing and thermally fusing pocket system intake and exhaust ports 201, tube system intake and exhaust ports 301, and tube members 310 arranged between a lower sheet 110 and an upper sheet 120 as illustrated in the drawings; an air system 200 (called a pocket system) with an airflow illustrated in FIG. 4, which includes the pocket system intake and exhaust ports 201, air pockets 210, and connection parts 220 between the air pockets bordering the tube members 310 and serves to support a user's weight; and an air system 300 (called a tube system) with an airflow illustrated in FIG. 5, which includes the tube system intake and exhaust ports 301, the tube members 310, and communication parts 320 between the tube members 310 and serves to block the airflow between the air pockets 210.

Figure 6:
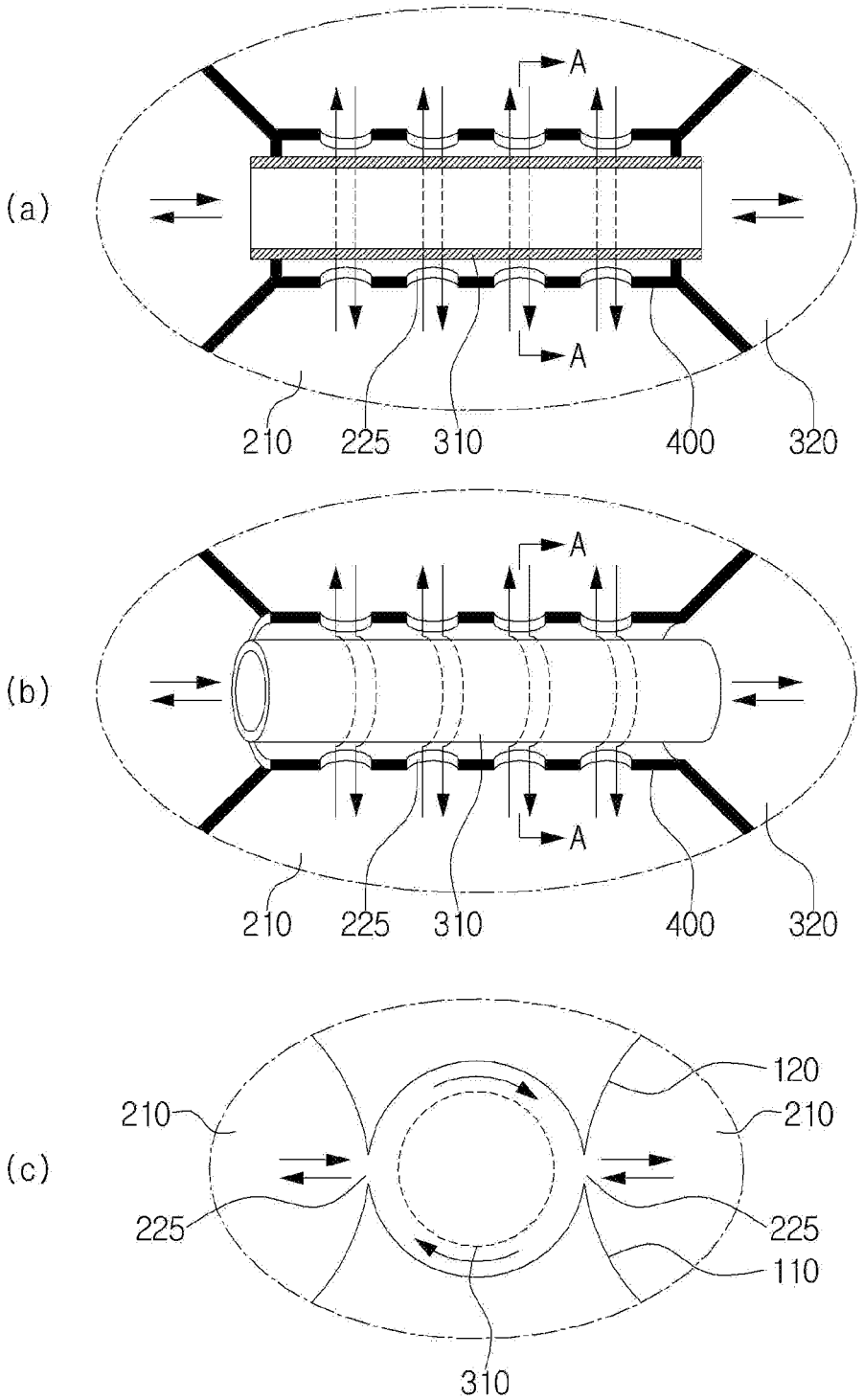
FIGS. 6(*a*), 6(*b*), and 6(*c*) are diagrams illustrating the airflow at a connection part 220 between air pockets according to the present invention.
Figure 7:
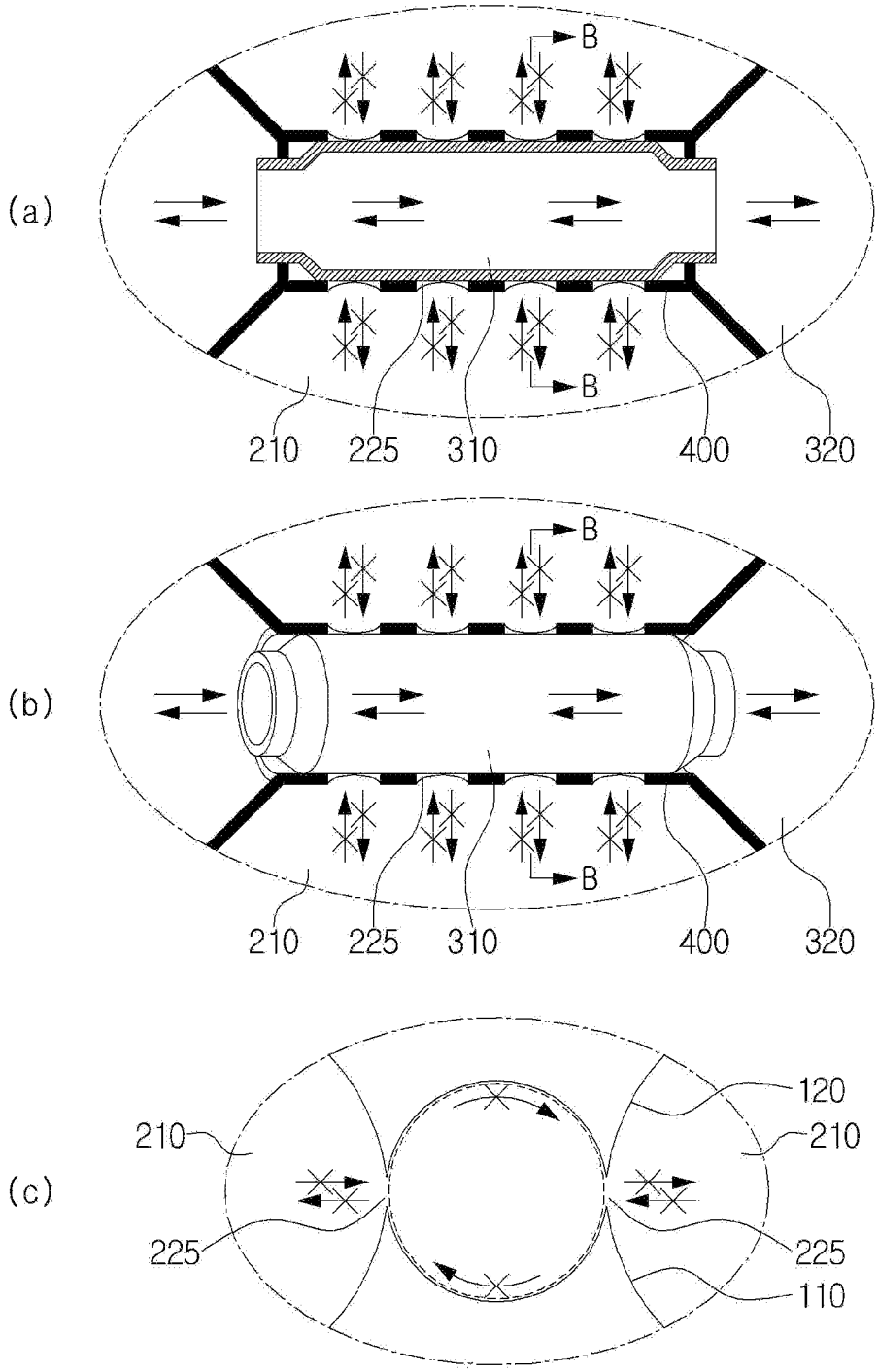
FIGS. 7(*a*), 7(*b*), and 7(*c*) are diagrams illustrating a state in which the airflow at the connection part 220 between air pockets is blocked according to the present invention.

When air is first injected into the pocket system 200, as illustrated in FIG. 6, an air flow between the air pockets 210 is allowed into gaps among air communication holes 225, which are formed by intentionally skipping heat-fusion at the connection parts 220 between the air pockets, a mattress member 100, and the tube members 310, such that the entire pocket system 200 is filled with air. Next, when air is injected into the tube system 300 at a higher pressure than the pocket system 200, the tube members 310 expand to block the gaps among the air communication holes 225, which are formed by intentionally skipping heat-fusion at the connection parts 220 between the air pockets, the mattress member 100, and the tube members 310, such that the airflow between the air pockets is blocked as illustrated in FIG. 7, and the air pockets 210 support the user's weight to alleviate excessive sagging of the part where the user's weight is applied, which was shown in the conventional air mattress, thereby providing insulation and cushioning between the user and the floor, and allowing the user to more easily move or turn over on the air mattress by reducing the height difference between the part sagged by the user's weight and the part to which the user's weight is not applied and the contact (friction) area between the user and the air mattress.

Figure 8:
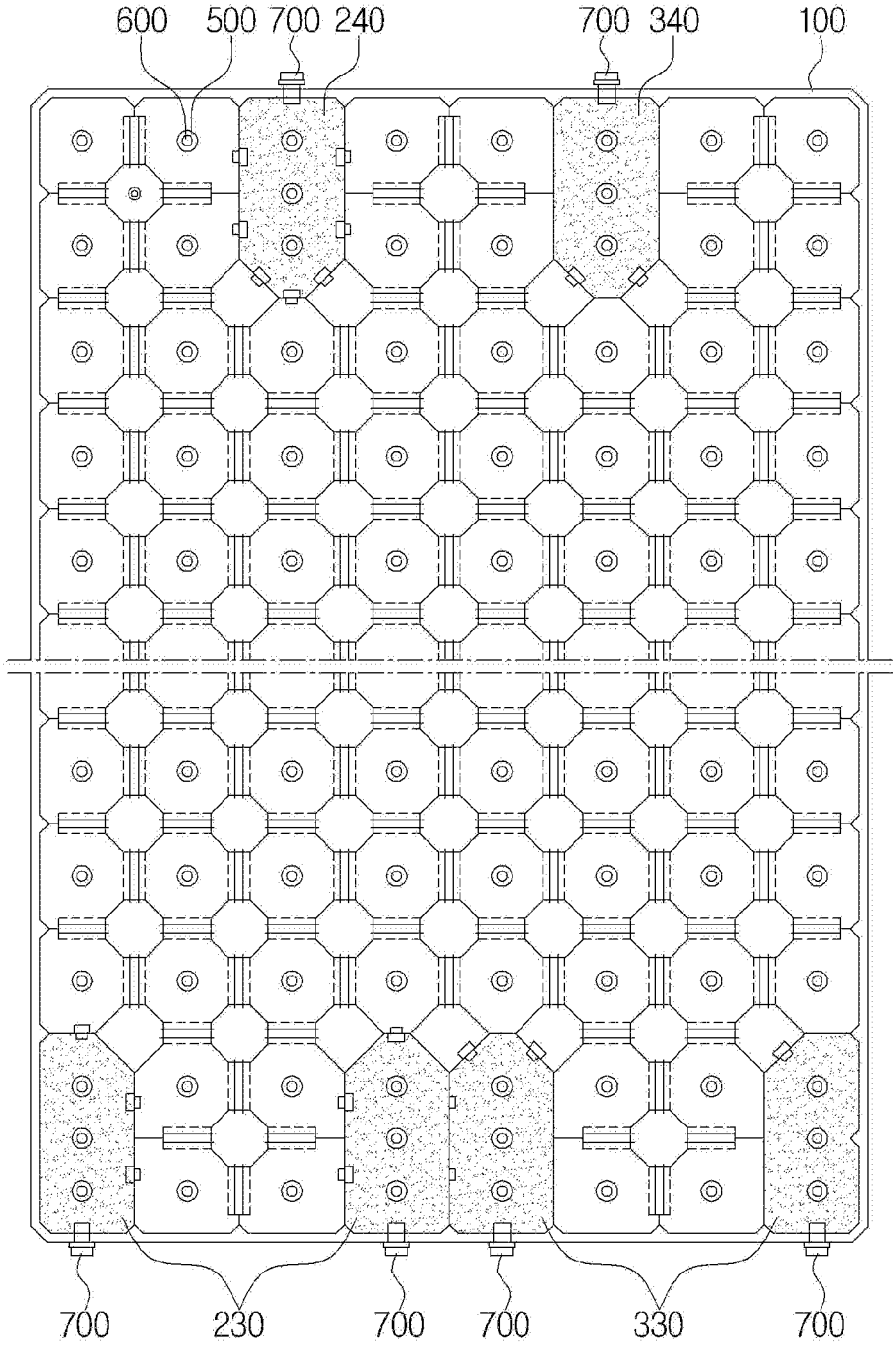
FIG. 8 is a plan view illustrating an air mattress according to an embodiment of the present invention.
Figure 9:
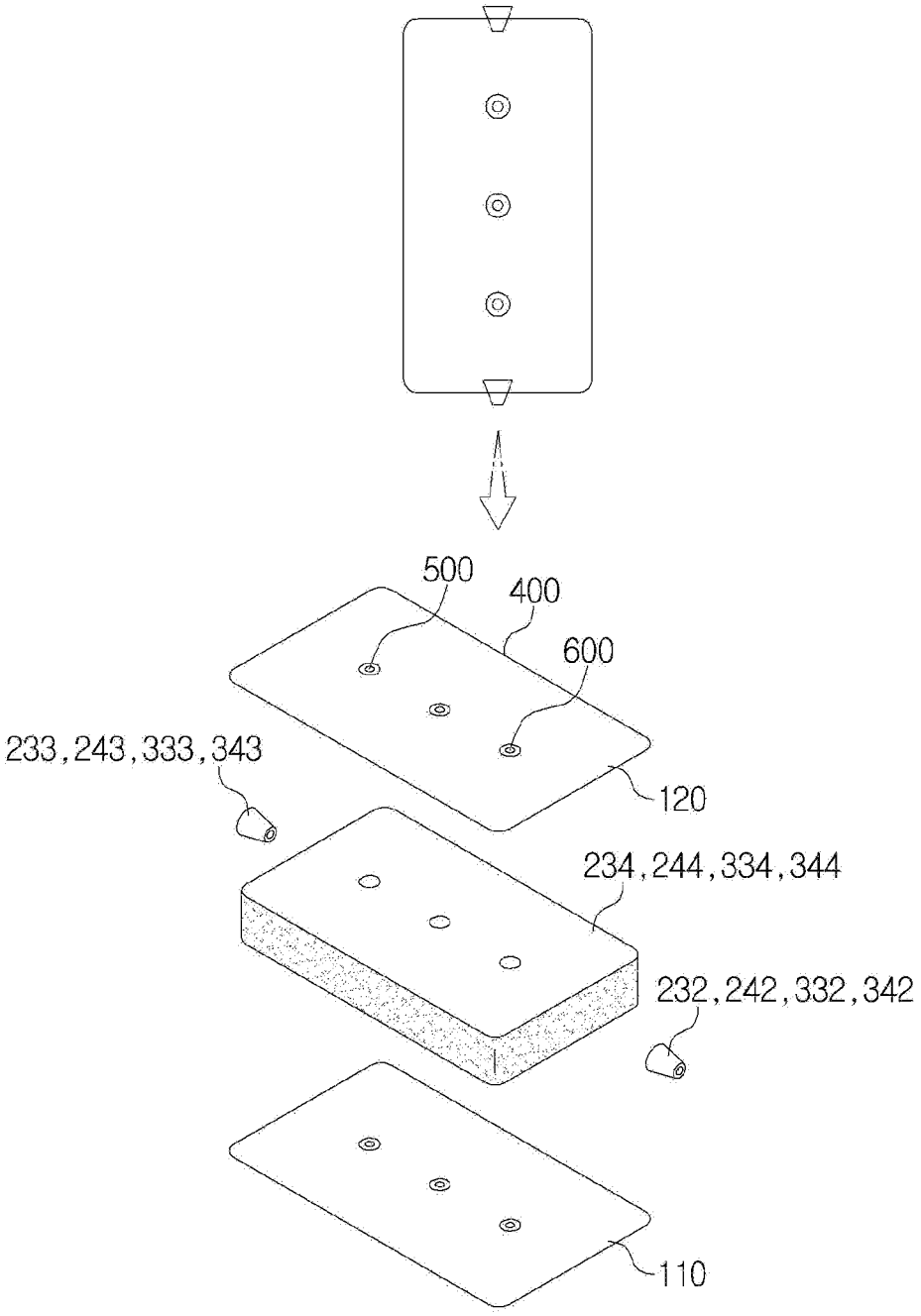
FIG. 9 is a diagram illustrating the configuration of air pumps 230, 240, 330, and 340 according to the present invention.

As illustrated in FIG. 9, specific spaces formed by heat-fused lines 400 between the mattress members 100 are filled with elastic bodies 234, 244, 334, and 344, and intake ports 232, 242, 332, and 342 and exhaust ports 233, 243, 333, and 343 having check valves allowing airflow in only one direction are provided across the heat-fused lines 400. When pressure is applied to the elastic bodies 234, 244, 334, and 344, air contained in the elastic bodies 234, 244, 334, and 344 is sent to the exhaust ports 233, 243, 333, and 343. When the pressure applied to the elastic bodies 234, 244, 334, and 344 is removed, air is inhaled into the intake ports 232, 242, 332, and 342 by the restoring force. When the above processes are repeated, since air pumps 230, 240, 330, and 340 serving as a pump are formed in the air mattress as illustrated in FIG. 8, there is no need to blow air into the air mattress orally or prepare an air pump.

As illustrated in FIG. 8, two pocket system air intake pumps 230, two tube system air intake pumps 330, one pocket system air discharge pump 240, and one tube system air discharge pump 340 are provided in pair and alternately apply pressure to continuously inject and discharge air.

As illustrated in FIG. 8, there are heat-fused points 500 formed by pressing and thermally fusing a central position or some portions of the mattress member 100 on the plane of the air pockets 210 at regular intervals to allow an appropriate adjustment of the height of the air mattress filled with air, thereby reducing the risk that a person who steps the air mattress filled with air may lose balance and fall over.

As illustrated in FIG. 8, there are holes or gaps 600 which penetrate the mattress member 100 and are located in the heat-fused points 500 to assist in water drainage, thereby making dehydration easy when the air mattress made of airtight synthetic resin fabric is washed.

Figure 10:
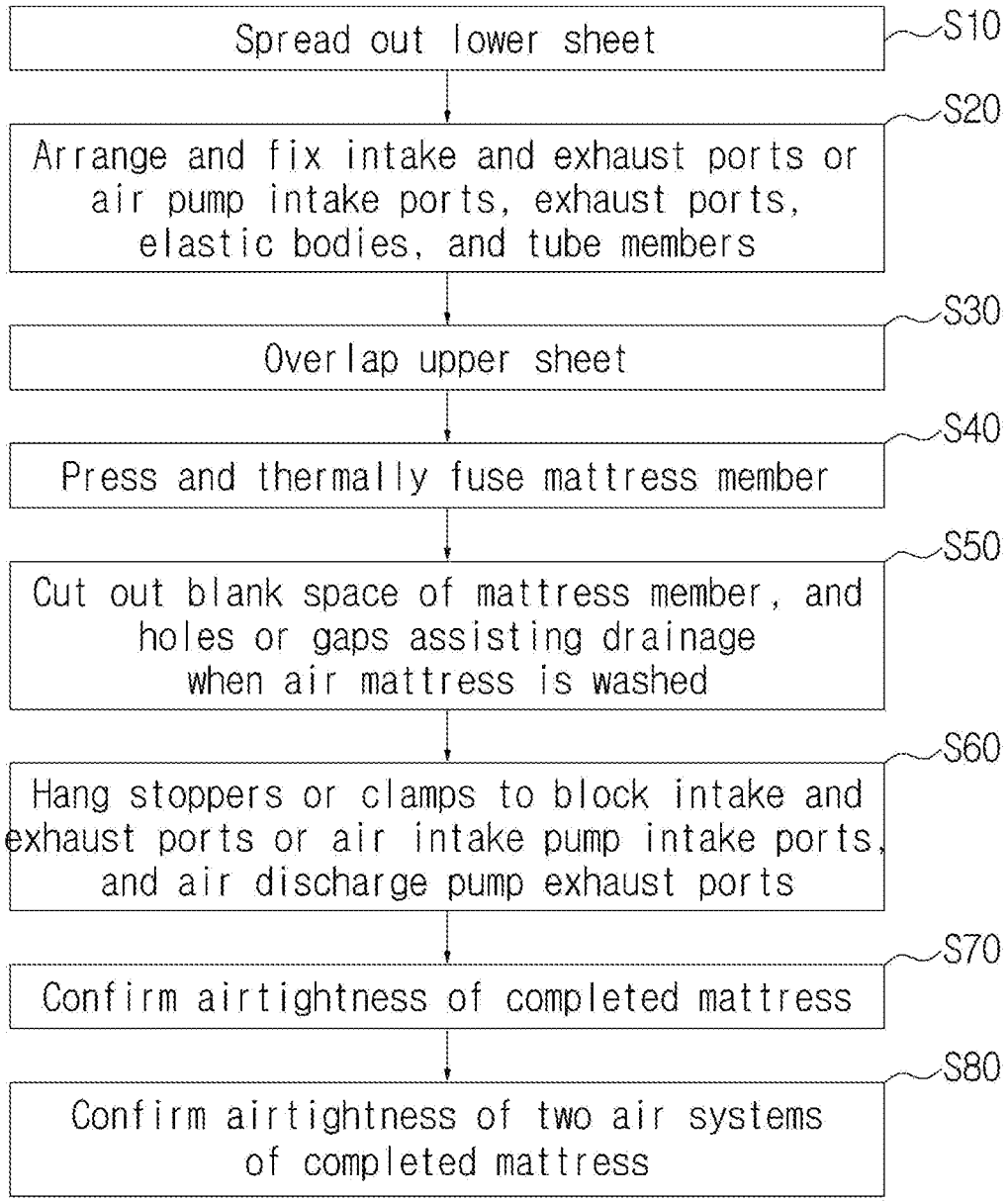
FIG. 10 is a flowchart illustrating a manufacturing process of the air mattress according to the present invention.

As illustrated in FIG. 10, the method for manufacturing the air mattress according to the present invention includes: a step (S10) of spreading out the lower sheet 110; a step (S20) of arranging and fixing the intake and exhaust ports 201 and 301 or the air pump intake ports 232, 242, 332, and 342, the exhaust ports 233, 243, 333, and 343, the elastic bodies 234, 244, 334, and 344, and the tube members 310; a step (S30) of overlapping the upper sheet 120; a step (S40) of pressing and thermally fusing the mattress member 100; a step (S50) of cutting out the blank space of the mattress member 100 and the holes or the gaps 600 assisting drainage when the air mattress is washed; a step (S60) of hanging stoppers or clamps 700 to block the intake and exhaust ports 201 and 301 or the air intake pump intake ports 232 and 332, and the air discharge pump exhaust ports 243 and 343; a step (S70) of filling two air systems of the completed air mattress with air and immersing in liquid to confirm the airtightness by checking whether bubbles are generated; and a step (S80) of deflating one of the air systems of the completed air mattress and inflating the other one of the air systems to confirm airtightness between the two air systems by observing whether the deflated air system is swollen.

What is claimed is:

1. An air mattress, in which, when used as a mat, an air layer inflated into a sealed space formed by a bilaminar airtight fabrics and a bonding line between the bilaminar airtight fabrics supports a user's weight to provide insulation and cushioning between the user and the floor, and which when not used, is deflated to reduce the volume and is folded for easy handling, the air mattress comprising:

heat-fused lines formed by pressing and thermally fusing pocket system intake and exhaust ports, tube system intake and exhaust ports, and tube members arranged between a lower sheet and an upper sheet; a pocket system, which includes the pocket system intake and exhaust ports, air pockets, and connection parts between the air pockets bordering the tube members, and serves to support a user's weight; and a tube system, which includes the tube system intake and exhaust ports, the tube members, and communication parts between the tube members, and serves to block the airflow between the air pockets, wherein when air is first injected into the pocket system, an air flow between the air pockets is allowed into gaps among air communication holes, a mattress member, and the tube members, such that the entire pocket system is filled with air, and when air is injected into the tube system at a higher pressure than the pocket system, the tube members expand to block the gaps among the air communication holes, the mattress member, and the tube members such that the airflow between the air pockets is blocked and the air pockets support the user's weight to alleviate excessive sagging of the part where the user's weight is applied, thereby providing insulation and cushioning between the user and the floor, and allowing the user to more easily move or turn over on the air mattress by reducing the height difference between the part sagged by the user's weight and the part to which the user's weight is not applied and the contact (friction) area between the user and the air mattress.

2. The air mattress according to claim 1, wherein some portions of the air mattress serve as air pumps, so there is no need to blow air into the air mattress orally or prepare an air pump.

3. The air mattress according to claim 1, wherein two pocket system air intake pumps, two tube system air intake pumps, one pocket system air discharge pump, and one tube system air discharge pump are provided in pairs, such that pressure is applied to the paired pumps to continuously inject and discharge air.

4. The air mattress according to claim 1, wherein heat-fused points are formed by pressing and thermally fusing a central position or some portions of the mattress member on the plane of the air pockets at regular intervals to allow an appropriate adjustment of the height of the air mattress filled with air, thereby reducing the risk that a person who steps the air mattress filled with air loses balance and falls over.

5. The air mattress according to claim 1, wherein holes or gaps which penetrate the mattress member to assist drainage are located in the heat-fused points, thereby making dehydration easy when the air mattress made of airtight synthetic resin fabric is washed.

6. A method of manufacturing an air mattress comprising the steps of:

spreading out a lower sheet;

arranging and fixing intake and exhaust ports or air pump intake ports, exhaust ports, elastic bodies, and tube members on the lower sheet;

overlapping an upper sheet;

pressing and thermally fusing a mattress member between the lower sheet and the upper sheet;

cutting out a blank space of the mattress member and holes or gaps assisting drainage when the air mattress is washed;

hanging stoppers or clamps to block the intake and exhaust ports or the air intake pump intake ports, and the air pump exhaust ports;

filling two air systems of the completed air mattress with air and immersing in liquid to confirm the airtightness by checking whether bubbles are generated; and deflating one of the air systems of the completed air mattress and inflating the other one of the air systems to confirm airtightness between the two air systems by observing whether the deflated air system is swollen.

* * * * *